US007735529B2

(12) United States Patent
Lawrence et al.

(10) Patent No.: US 7,735,529 B2
(45) **Date of Patent: *Jun. 15, 2010**

(54) DRIPLESS NOZZLE

(75) Inventors: James L. Lawrence, Wilson, NC (US); Charles S. Pearson, Wilson, NC (US); Jose Rodriguez, Chulavista, CA (US)

(73) Assignee: EMCO Wheaton Retail Corporation, Wilson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/798,509

(22) Filed: May 15, 2007

(65) Prior Publication Data

US 2007/0215241 A1 Sep. 20, 2007

Related U.S. Application Data

(63) Continuation of application No. 11/328,188, filed on Jan. 10, 2006, now Pat. No. 7,216,680, which is a continuation of application No. 10/882,639, filed on Jul. 2, 2004, now Pat. No. 6,983,772.

(51) Int. Cl.
*B65B 1/04* (2006.01)

(52) U.S. Cl. ..... 141/311 A; 141/392; 222/571; 137/312

(58) Field of Classification Search ..... 141/206–229, 141/311 A, 392; 222/571; 137/312
See application file for complete search history.

(56) References Cited

U.S. PATENT DOCUMENTS 573,759 A 12/1896 Brown
1,357,629 A 11/1920 Faistl et al.
4,113,153 A 9/1978 Wellman
4,214,614 A 7/1980 Pyle
D307,115 S 4/1990 Waymack
5,000,360 A 3/1991 Lown et al.
5,067,639 A 11/1991 Maguire et al.
5,169,040 A 12/1992 Wiley
5,228,596 A 7/1993 McNally
5,377,729 A 1/1995 Reep
5,603,364 A 2/1997 Kerssies
5,620,031 A 4/1997 Dalhart et al.
5,620,032 A 4/1997 Dame
5,645,116 A 7/1997 McDonald
5,704,522 A * 1/1998 Orgeolet et al. ..... 222/494

(Continued)

OTHER PUBLICATIONS

U.S. Appl. No. 10/975,228, pending.

*Primary Examiner*—Timothy L Maust
(74) *Attorney, Agent, or Firm*—Merek, Blackmon & Voorhees, LLC

(57) ABSTRACT

A nozzle for dispensing fuel into a vehicle. The nozzles includes a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. Preferably, at least one fuel collection member is provided for collecting fuel remaining in the body portion and the spout after the fuel control member shuts-off the flow of fuel through the spout to prevent dripping of fuel from the end of the spout.

16 Claims, 5 Drawing Sheets

U.S. PATENT DOCUMENTS

| | | | |
|---|---|---|---|
| 5,765,609 | A | 6/1998 | Dalhart et al. |
| 5,938,087 | A | 8/1999 | Randall |
| 6,349,860 | B1 | 2/2002 | McMahon et al. |
| 6,431,417 | B1 | 8/2002 | Kumar |
| 6,520,222 | B2 | 2/2003 | Carmack et al. |
| 6,835,223 | B2 | 12/2004 | Walker et al. |
| 6,854,491 | B1 | 2/2005 | Knight et al. |
| 6,941,984 | B2 | 9/2005 | Knight et al. |
| 6,983,772 | B1 | 1/2006 | Lawrence et al. |
| 7,036,536 | B1 | 5/2006 | Knight et al. |
| 7,063,112 | B2 | 6/2006 | Fink et al. |
| 7,216,680 | B2 | 5/2007 | Lawrence et al. |
| 7,270,154 | B2 * | 9/2007 | Walker et al. ..... 141/59 |
| 2005/0056340 | A1 | 3/2005 | Walker et al. |

* cited by examiner

DRIPLESS NOZZLE

RELATED APPLICATIONS

The subject patent application is a continuation of and claims priority under 35 USC §120 from the following U.S. patent applications: U.S. patent application Ser. No. 11,328,188 filed on Jan. 10, 2006, now U.S. Pat. No. 7,216,680, which in turn is a continuation of U.S. patent application Ser. No. 10/882,639 filed on Jul. 2, 2004, now U.S. Pat. No. 6,983,772. The entire contents of U.S. patent application Ser. No. 11,328,188 and U.S. patent application Ser. No. 10/882,639 are hereby incorporated by reference.

FIELD OF THE INVENTION

The present invention relates to fuel dispensing systems for dispensing fuel into a vehicle fuel tank. More particularly, the present invention relates to a dripless fuel dispensing nozzle for dispensing fuel into a vehicle fuel tank.

BACKGROUND OF THE INVENTION

Various nozzles have been proposed for use in fuel dispensing systems to transfer fuel from a storage tank to a vehicle fuel tank. Environmental and/or safety concerns have dictated that nozzles of a fuel dispensing system be designed to prevent fuel from dripping from the spout of the nozzle after the nozzle is removed from the vehicle fuel tank and returned to the dispenser.

U.S. Pat. Nos. 5,377,729; 5,645,116; 5,603,364; 5,620,032; and, 6,520,222 disclose various nozzle structures designed to prevent fuel from dripping from the spout once it is removed from a fuel tank. These designs have numerous inherent disadvantages. For example, a number of these prior designs require complex valves to prevent fuel dripping from the end of the spout of the nozzle. These valves increase the cost and time to manufacture the nozzle. Further, these prior designs all include a relatively large obstruction centrally located in the channel or passageway through which fuel travels through the nozzle and hence unnecessarily restrict the flow of fuel through the nozzle when a vehicle is being refueled.

OBJECTS AND SUMMARY OF THE INVENTION

An object of a preferred embodiment of the present invention is to provide a novel and unobvious nozzle that prevents excessive dripping from the end of the spout of the nozzle upon removal of the nozzle from a vehicle fuel tank after the refueling process has been completed.

Another object of a preferred embodiment of the present invention is to provide a nozzle that overcomes one or more disadvantages of previously known nozzles.

A further object of a preferred embodiment of the present invention is to provide a nozzle that can be readily and inexpensively manufactured.

Still a further object of a preferred embodiment of the present invention is to reduce the obstructions in the fuel channel or passageway present in prior designs to minimize the obstruction or restriction of the flow of fuel through the nozzle in the refueling process.

Yet still another object of a preferred embodiment of the present invention is to provide a dripless nozzle that does not rely upon a complex valve arrangement to prevent fuel dripping from the end of the spout of the nozzle.

Yet another object of a preferred embodiment of the present invention is to provide a structure that can be readily retrofitted to existing nozzles to prevent dripping from the end of the spout of the nozzle.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout to the vehicle. The spout has a first portion and a second portion. The first portion of the spout is positioned adjacent the body portion while the second portion of the spout is removed from the body portion. The first portion of the spout has a cross-sectional area greater than the second portion of the spout. A first fuel collection member is provided for collecting fuel remaining in the body portion and the spout after the fuel control member shuts-off the flow of fuel through the body portion and the spout. The first fuel collection member extends into the first portion of the spout and the second portion of the spout.

Another embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. A first fuel collection member is provided for collecting fuel remaining in the body portion and the spout after the fuel control member shuts-off the flow of fuel through the spout. At least a portion of the rust fuel collection member extends into the first portion of the spout. A second fuel collection member is provided for collecting fuel remaining in the body portion and the spout after the fuel control member shuts-off the flow of fuel through the spout. The second fuel collection member is located in the second portion of the spout.

A further embodiment of the present invention is directed to a nozzle for dispensing fuel into a vehicle. The nozzle includes a body portion and a spout extending from the body portion. The spout passes fuel from the body portion into a vehicle. The body portion includes a fuel flow control member for allowing or preventing fuel from passing through the body portion and the spout into the vehicle. The spout has first and second portions. The first portion is positioned adjacent the body portion and the second portion is removed from the body portion. The spout has a primary fuel collection area for collecting fuel remaining in the body portion and the spout after the fuel control member shuts-off the flow of fuel through the spout. The spout further includes a secondary fuel collection area for collecting fuel remaining in the body portion and the spout after the fuel control member shuts-off the flow of fuel through the spout.

Still a further embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. A first fuel collection member is provided for collecting fuel remaining in the body portion and the spout after the fuel control member shuts-off the flow of fuel through the spout. The first fuel collection member is press-fit into the spout.

Yet still a further embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the scout is removed from the body portion. A first fuel collection member is provided for collecting fuel remaining in the body portion and the spout after the fuel control member shuts-off the flow of fuel through the spout. The first fuel collection member is fixed relative to the spout such that the first fuel collection member does not move relative to the spout.

DETAILED DESCRIPTION OF THE PREFERRED EMBODIMENTS OF THE INVENTION

The most preferred forms of the invention will now be described with reference to FIGS. 1-6. The appended claims are not limited to the most preferred forms and no term used herein is to be given a meaning other than its ordinary meaning unless accompanied by a statement that the term "as used herein is defined as follows".

FIGS. 1 Through 6

Figure 1:
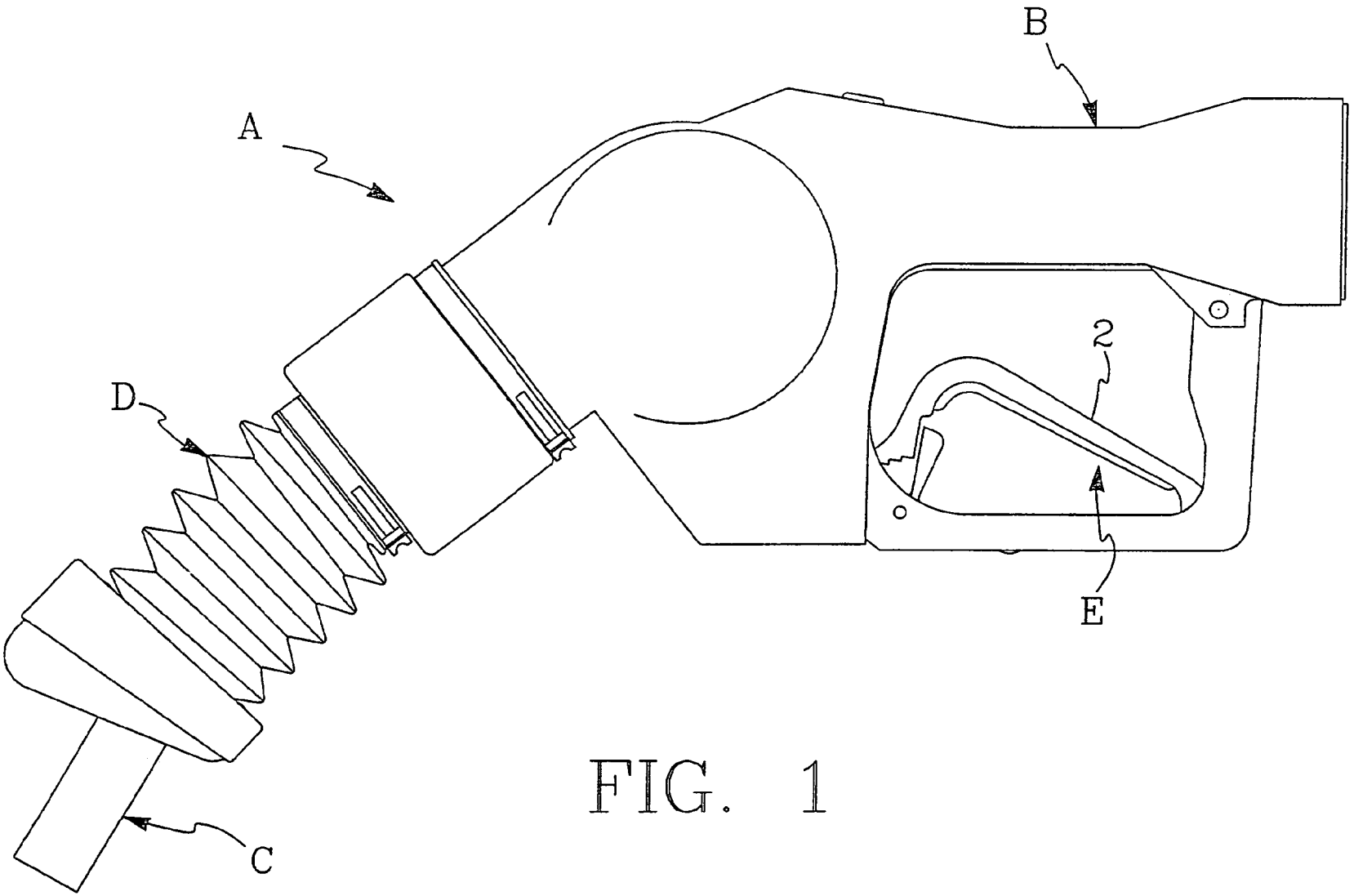
FIG. 1 is an elevational view of a nozzle formed in accordance with the most preferred embodiment of the present invention.
Figure 2:
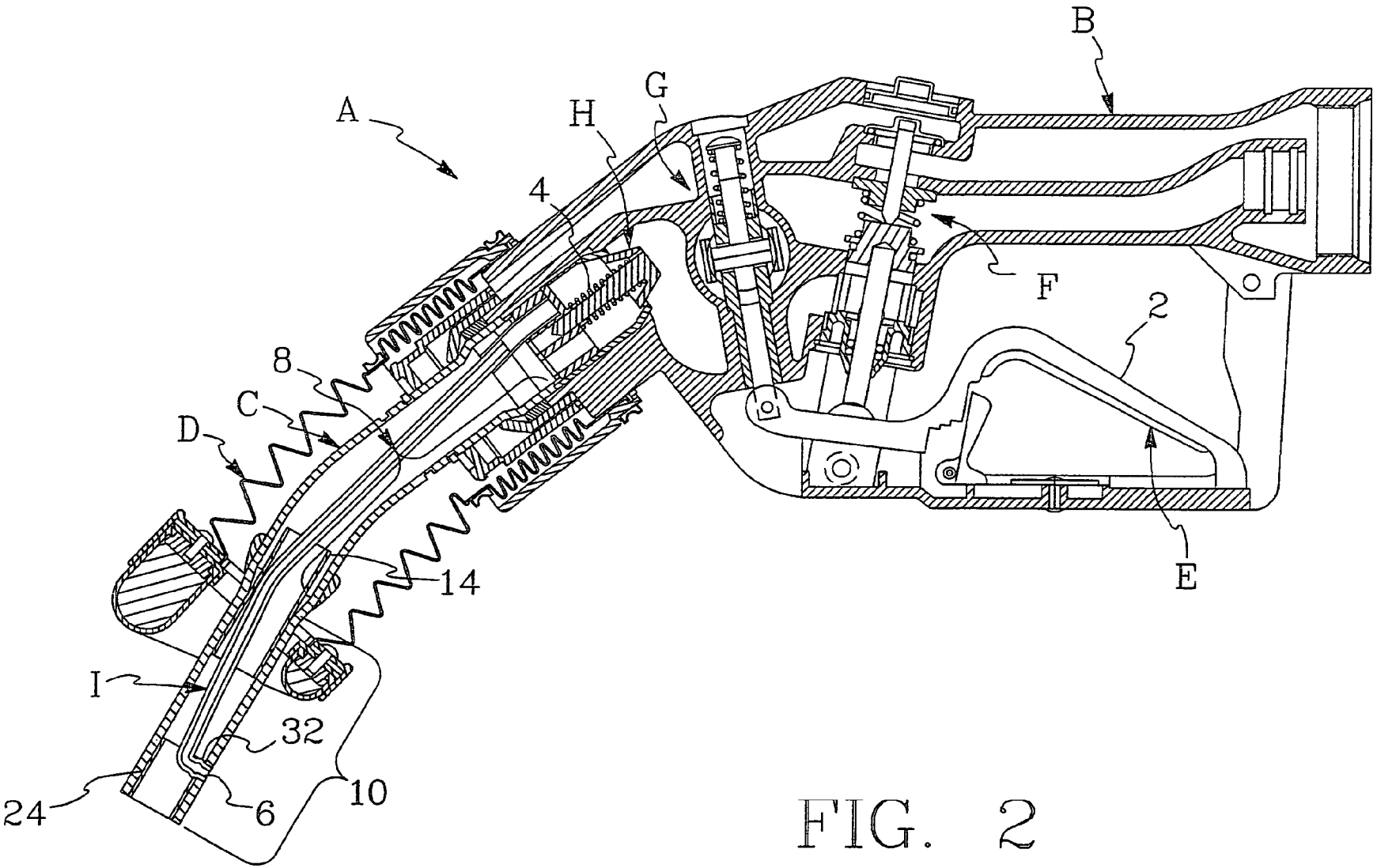
FIG. 2 is a cross-sectional view of the nozzle depicted in FIG. 1.
Figure 3:
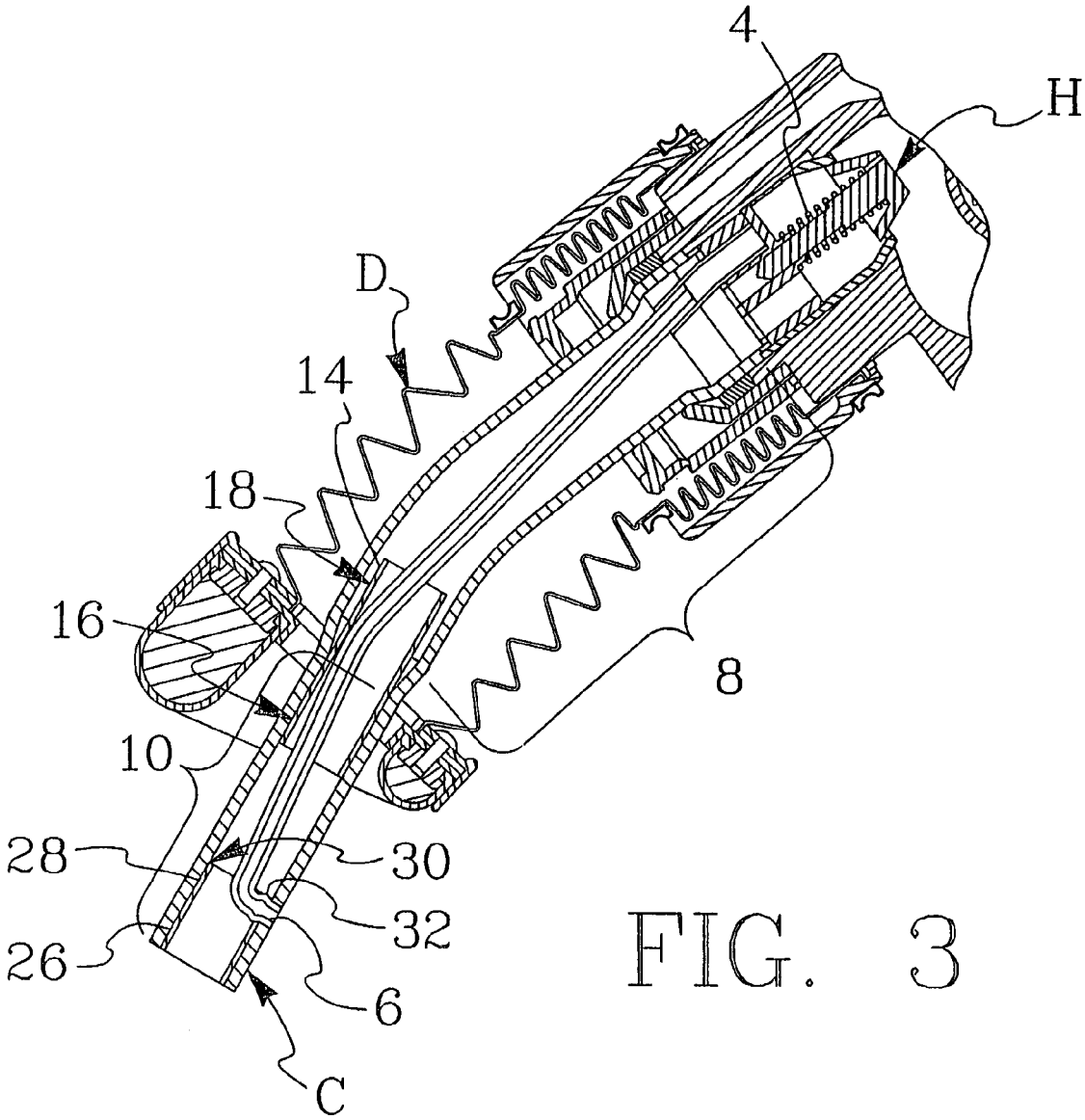
FIG. 3 is an enlarged fragmentary cross-sectional view depicted in FIG. 1.

Referring to FIGS. 1 to 3, a nozzle A is illustrated in one of many possible configurations. While the nozzle A depicted in FIGS. 1 to 3 is of the vapor recovery type, the present invention is in no way limited to vapor recovery nozzles. Rather, the present invention can be used in any form of nozzle.

Referring to FIGS. 1 to 3, nozzle A includes a body portion B, a spout C, a vapor recovery shroud D, trigger mechanism E, a main valve F, a releasable latching mechanism G, a restrictor plug H and a vent tube I. The function of the vapor recovery shroud D and related vapor recovery components are well known and, therefore, will not be described herein. However, it should be noted that the vapor recovery shroud D and all related vapor recovery components maybe omitted in their entirety.

When an individual grabs and raises handle 2 of the trigger mechanism E, the main valve F opens in a well known manner allowing fuel to pass through the body portion B of the nozzle A in the direction of the restrictor plug H. As seen in FIG. 2, the restrictor plug H is biased in a closed position by spring 4. As the fuel flows through the body portion B, the force of the spring 4 is overcome and restrictor plug H moves toward the spout C allowing fuel to flow freely through the spout C and into the fuel tank of a vehicle. Fuel will continue to flow provided the handle is still engaged until such time as the opening 6 of the vent tuber I becomes blocked. Upon reaching this condition, the releasable latching mechanism G is activated in a conventional manner to close the main valve F thereby preventing fuel from flowing to the spout C. Once the flow of fuel is discontinued, it is desirable to prevent residual fuel in the body B and spout C from dripping out of the end of the spout C. The preferred form of the invention concerns the spout C shown in FIGS. 2 through 6. While FIGS. 2 to 6 illustrate the preferred form, the invention is in no way limited to the form depicted in these figures.

Figure 4:
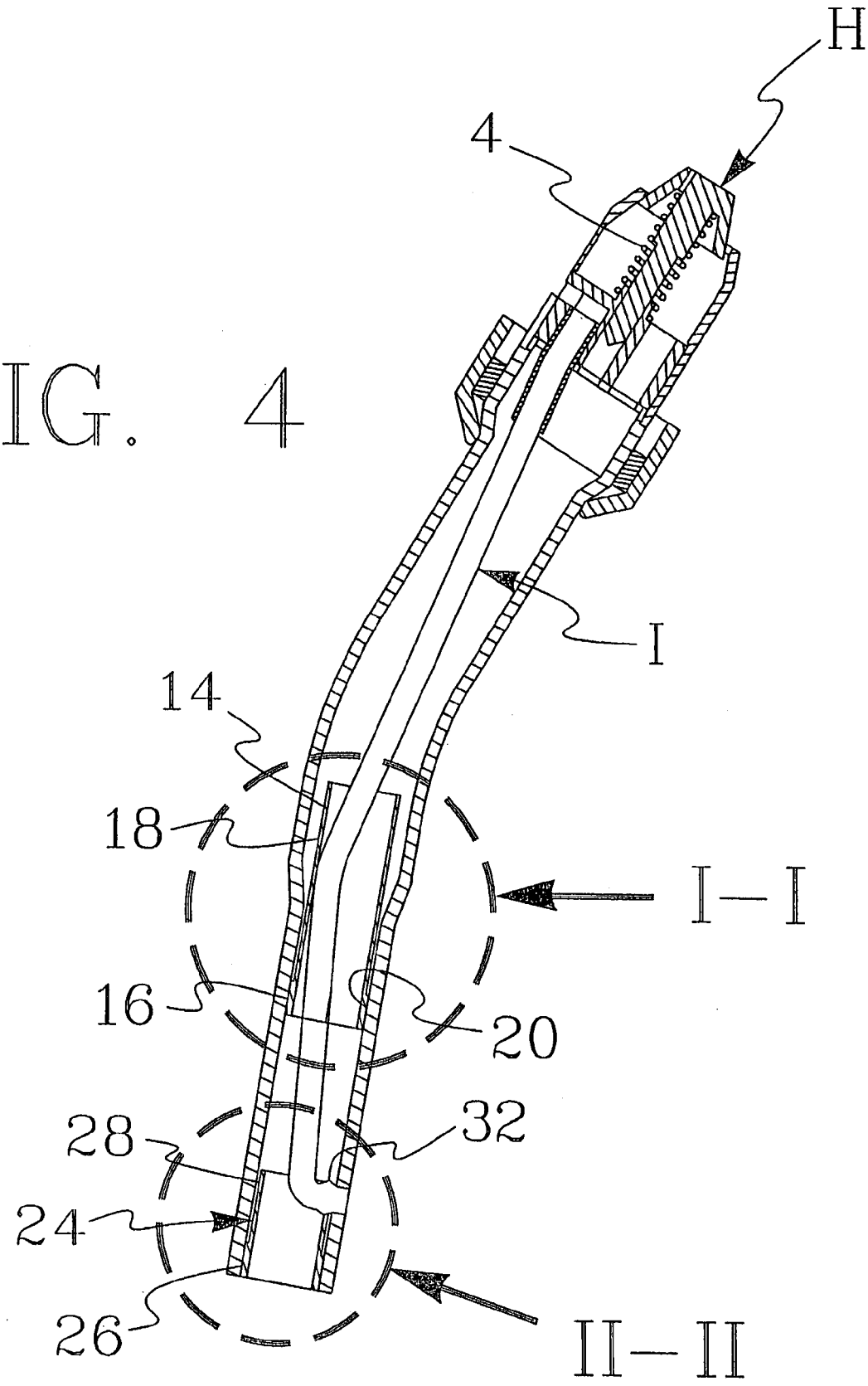
FIG. 4 is a cross-sectional view of a portion of a nozzle formed in accordance with the most preferred embodiment of the present invention.

Spout C shown in FIGS. 2, 3 and 4 has a first section 8 and a second section 10. The first section 8 is positioned directly adjacent the body portion B of the nozzle A. The second section 10 extends outwardly from the first section 8 and is removed or spaced from the body portion B, as seen for example in FIG. 2. The cross-sectional area of the first section 8 is greater than the cross-sectional area of the second section 10.

Figure 5:
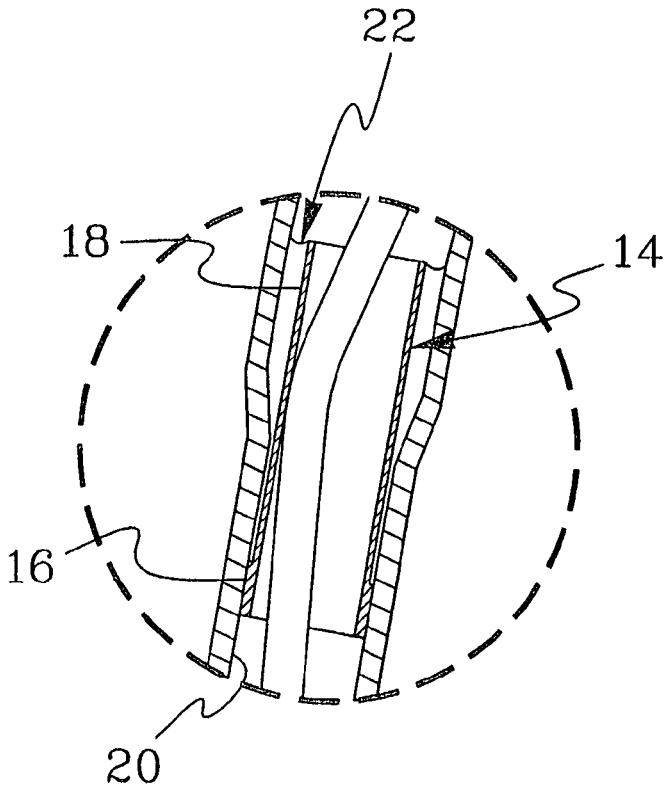
FIG. 5 is an enlarged view of the portion I-I of FIG. 4.
Figure 6:
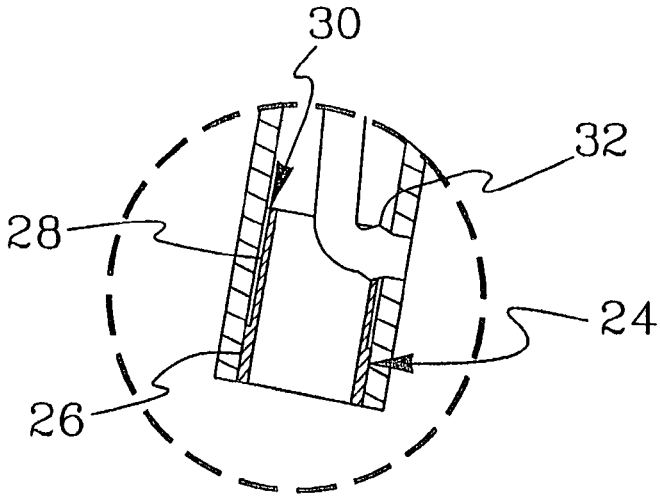
FIG. 6 is an enlarged view of the portion II-II of FIG. 4.

Referring to FIGS. 2, 3, 4 and 5, a first fuel collector 14 is positioned adjacent of the juncture of first section 8 and second section 10 of spout C. More specifically, the first collector 14 preferably extends into both the first section 8 and the second section 10. Preferably, the first collector 14 is substantially cylindrical in share with a substantially uniform inner diameter. The outer wall of the first collector 14 is preferably stepped at the lowermost end. Specifically, the outer wall of segment 16 extends outwardly a distance greater than the outer wall of segment 18 of the first collector 14 as seen in FIGS. 3, 4 and 5. This allows the outer wall of segment 16 to directly abut the adjacent portion of the inner wall 20 of spout C creating a seal that prevents fuel from passing between the inner wall of the spout C and the outer wall of segment 16.

By spacing the outer wall of segment 18 of the first collector 14 from the inner wall of spout C, an annular collection area 22 is created for collecting residual fuel in the nozzle A after the flow of fuel is discontinued. Fuel is shown in collection area 22 in FIGS. 4 and 5. By locating the first collector 14 adjacent the juncture of the first section 8 and the second section 10, the collection area is relatively large due to the larger cross-sectional area of the first section 8. It should be noted that the first collector is effective act collecting residual fuel due to the fact that the residual fuel tends to travel along the inner wall of the spout C when the nozzle is pointed downwardly. Preferably, the first collector 14 is press fit into the desired position. As such, the first collector 14 is fixed relative to the spout C, i.e., the first collector 14 does not move relative to the spout C. While press fitting is preferred, it will be readily appreciated that other arrangements may be employed. For example, the first collector 14 and the spout C may be formed as one piece.

Referring to FIGS. 2, 3, 4 and 6, a second collector 24 is preferably formed adjacent the end of spout C. Preferably, the second collector 24 is substantially cylindrical in shape with a substantially uniform inner diameter. The outer wall of the second collector 24 is preferably stepped at the lowermost end. Specifically, the outer wall of segment 26 extends outwardly a distance greater than the outer wall of segment 28 of the second collector 24. This allows the outer wall of segment 26 to directly abut the adjacent portion of the inner wall 20 of spout C creating a seal that prevents fuel from passing between the inner wall of the spout C and the outer wall of segment 26. By spacing the outer wall of segment 28 of the second collector 24 from the inner wall of spout C, an annular collection area 30 is created for collecting residual fuel in the nozzle A that is not collected in first collector 14 after the flow of fuel is discontinued through nozzle A. Fuel is shown in collection area 30 in FIGS. 4 and 6.

Referring to FIGS. 2 and 3, segment 23 has an opening formed therein so that the adjacent end of the vent tube I can extend through the second collector 24. An annular rib 32 is formed on the outer surface of the vent tube I adjacent the opening in the segment 23 to prevent fuel from leaking from the collection area 30. Preferably, the second collector 24 is press fit into the desired position. As such, the second collector 24 is fixed relative to the spout C, i.e., the second collector 24 does not move relative to the spout C. While press fitting is preferred, it will be readily appreciated that other arrangements may be employed. For example, the second collector 24 and the spout C may be formed as one piece.

While this invention has been described as having a preferred design, it is understood that the preferred design can be further modified or adapted following in general the principles of the invention and including but not limited to such departures from the present invention as come within the known or customary practice in the art to which the inventions pertains. The claim are not limited to the preferred embodiment and have been written to preclude such a narrow construction using the principles of claim differentiation.

We claim:

1. A nozzle for dispensing fuel into a vehicle, said nozzle composing:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having a first portion and a second portion, said first portion of said spout being positioned adjacent said body portion while said second portion of said spout being removed from said body portion, said first portion of said spout having a cross-sectional area greater than said second portion of said spout, said second portion of said spout having an opening formed in a lowermost end of said second portion of said spout to permit fuel to pass from said spout to the vehicle, said opening remains open when said fuel control member permits and prevents fuel from passing through said body portion and said spout; and, (c) a first fuel collection member for collecting fuel remaining in said body portion and said spout after said fuel flow control member shuts-off the flow of fuel through said body portion and said spout, said first fuel collection member being a separate piece from said spout and having at least a first section that is substantially tubular, said first collection member forming a first collection area that completely surrounds said substantially tubular first section.

2. A nozzle as set forth in claim 1, wherein:

(a) said first collection area has a width and a height, said height is at least two time greater than said width.

3. A nozzle as set forth in claim 1, wherein:

(a) said first fuel collection member further includes a second section, said first section and said second section each have an outer wall, said outer wall of said first section is disposed inwardly of said outer wall of said second section.

4. A nozzle as set forth in claim 1, wherein:

(a) said first fuel collection member is fixed relative to said spout.

5. A nozzle as set forth in claim 1, further including:

(a) a second fuel collection member for collecting fuel remaining in said body portion and said spout after said fuel flow control member shuts-off the flow of fuel through said body portion and said spout.

6. A nozzle as set forth in claim 5, wherein:

(a) at least a portion of said second fuel collection member is located in said first portion of said spout and said first fuel collection member is disposed entirely within said second portion of said spout.

7. A nozzle as set forth in claim 5, wherein:

(a) said second fuel collection member is press fit into said first portion of said spout.

8. A nozzle for dispensing fuel into a vehicle, said nozzle comprising:

(a) a body portion and a spout extending from said body portion, said spout passing fuel from said body portion into a vehicle, said body portion including a fuel flow control member for allowing or preventing fuel from passing through said body portion and said spout into the vehicle, said spout having first and second portions, said first portion being positioned adjacent said body portion and said second portion being removed from said body portion, said second portion of said spout having an opening formed in a lowermost end of said second portion of said spout to permit fuel to pass from said spout to the vehicle, said opening remains open when said fuel control member permits and prevents fuel from passing through said body portion and said spout;

(b) said spout having a first fuel collection area for collecting fuel remaining in said body portion and said spout after said fuel control member shuts-off the flow of fuel through said spout, said first collection area being formed by a first collection member inserted into said opening of said spout, said first collection member having at least a first tubular section, said first tubular section being disposed inwardly of an inner wall of said spout to create a first collection area that extends around the entire circumference of said first tubular section.

9. A nozzle as set forth in claim 8, wherein:

(a) said first annular section of said first collection member engages an inner wall of said spout.

10. A nozzle as set forth in claim 9, wherein:

(a) said first collection member has a second annular section, said second annular section being spaced inwardly from said inner wall of said spout to form and annular collection cavity.

11. A method of forming a nozzle for dispensing fuel into a vehicle, said method comprising the steps of:

(a) providing a body portion and a spout extending from said body portion, said spout passing fuel from said body portion to a vehicle, said body portion including a fuel flow control member for allowing or preventing fuel from passing through said body portion and said spout into the vehicle, said spout having first and second portions, said first portion of said spout being positioned adjacent said body portion and said second portion of said spout being removed from said body portion, said second portion of said spout having an opening formed in a lowermost end of said second portion of said spout to permit fuel to pass from said spout to the vehicle, said opening remains open when said fuel control member permits and prevents fuel from passing through said body portion and said spout;

(b) providing a first fuel collection member for collecting fuel remaining in said body portion and said spout after said fuel control member shuts-off the flow of fuel through said spout, said first collection member having at least a first tubular section, said first tubular section being disposed inwardly of an inner wall of said spout; and, (c) inserting said first fuel collection member into said spout and fixing said first fuel collection member relative to said spout to create a first collection area that extends around the entire circumference of said first tubular section.

12. A method as recited in claim 11, including the further step of:

(a) configuring said first fuel collection member such that an annular collection cavity is formed when said first fuel collection member is inserted into said spout and fixed relative to said spout.

13. A method as recited in claim 11, including the further step of:

(a) press fitting said first collection member to said inner wall of said spout.

14. A method of retrofitting a nozzle used to dispense fuel into a vehicle such that the nozzle is provided with at least one collection area for collecting fuel remaining in a body portion of a spout of the nozzle after a fuel control member shuts-off the flow of fuel through the spout, said method comprising the steps of:

(a) providing a first fuel collection member for collecting fuel remaining in a body portion of a spout of a nozzle after a fuel control member shuts-off the flow of fuel through said spout, said first fuel collection member having at least a first section that is substantially tubular; and, (c) inserting said first fuel collection member into an opening in said spout and fixing said first fuel collection member relative to said spout such that the opening in the spout of said nozzle remains open when said fuel control member permits and prevents fuel from passing through said body portion and said spout and said first collection member forms a first collection area that completely surrounds said substantially tubular first section.

15. A method as recited in claim 14, wherein:

(a) said first fuel collection member includes a first annular section engaging an inner wall of the spout.

16. A method as recited in claim 15, wherein:

(a) said first fuel collection member includes a second annular section spaced inwardly from the inner wall of the spout.

* * * * *

UNITED STATES PATENT AND TRADEMARK OFFICE

CERTIFICATE OF CORRECTION

PATENT NO. : 7,735,529 B2
APPLICATION NO. : 11/798509
DATED : June 15, 2010
INVENTOR(S) : James L. Lawrence, Charles S. Pearson and Jose Rodriquez It is certified that error appears in the above-identified patent and that said Letters Patent is hereby corrected as shown below:

Under Figs. 1 through 6, column 5, line 12, "segment 23" should be -- segment 28 --

Under Figs. 1 through 6, column 5, line 16, "segment 23" should be -- segment 28 --

Signed and Sealed this

Seventeenth Day of August, 2010

David J. Kappos

David J. Kappos
*Director of the United States Patent and Trademark Office*